US005137380A

United States Patent [19]

Andou et al.

[11] Patent Number: 5,137,380

[45] Date of Patent: Aug. 11, 1992

[54] WIRE-DOT PRINT HEAD

[75] Inventors: Hirokazu Andou; Mitsuru Kishimoto; Noboru Ooishi; Yoichi Umezawa, all of Tokyo, Japan

[73] Assignee: Oki Electric Industry Co., Ltd., Tokyo, Japan

[21] Appl. No.: 596,724

[22] Filed: Oct. 10, 1990

[30] Foreign Application Priority Data

Oct. 11, 1989 [JP] Japan ..... 1-118279[U]

[51] Int. Cl.[5] ..... B41J 2/28

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,348,120 | 9/1982 | Isobe et al. | 400/124 |
| 4,513,496 | 4/1985 | Wang | 400/124 |
| 4,582,437 | 4/1986 | Wang | 400/124 |
| 4,714,904 | 12/1987 | Willems | 310/349 |
| 4,869,605 | 9/1989 | Kikuchi et al. | 400/124 |
| 4,995,744 | 2/1991 | Goldowsky et al. | 400/124 |

FOREIGN PATENT DOCUMENTS 228872 7/1987 European Pat. Off. .

331285 9/1989 European Pat. Off. .

OTHER PUBLICATIONS

Patent Abstracts of Japan, vol. 12, nr. 78 (M-675) [2925], Mar. 11, 1988; & JP-A-62 218 144 (Fujitsu Ltd) Sep. 25, 1987.

*Primary Examiner*—Edgar S. Burr
*Assistant Examiner*—Lynn Hendrickson
*Attorney, Agent, or Firm*—Wenderoth, Lind & Ponack

[57] ABSTRACT

A wire-dot print head has an armature having a tip to which a print wire is secured, a core provided in confrontation with the armature, a plate spring which is supported in a cantilever fashion and to which the armature is fixed, a permanent magnet assembly generating a magnetic flux to cause the armature to be attracted toward the core overcoming the resilient force of the plate spring, and a coil wound on the core to generate a magnetic flux upon energization to cancel the magnetic flux from the permanent magnet assembly, thereby to release the armature. The permanent magnet assembly includes a first permanent magnet of the samarium-cobalt type, and a second permanent magnet of the neodyminum-iron-boron type or the lanthanoid-iron-boron type.

10 Claims, 4 Drawing Sheets

WIRE-DOT PRINT HEAD

FIELD OF THE INVENTION

The present invention relates to a wire-dot print head in a printer which prints by driving print wires fixed to tips of armatures.

BACKGROUND OF THE INVENTION

Serial printers employing a wire-dot print head can be used to print on a variety of print media, such as multi-ply print papers, and they are used extensively. The wire-dot print heads drive wires by magnetic attracting force of a permanent magnet or electromagnet.

The impact printers can be divided, according to the type of the wire-dot print head, into the plunger type, the spring-charge type, and the clapper type.

The spring-charge type is of a structure in which an armature to which a print wire is fixed is supported to a plate spring in such a way that it can be swung, and the armature is attracted to a core by a permanent magnet overcoming the resilient force of the plate spring, and for printing, the coil wound on the core is energized to generate a magnetic flux in opposition to the magnetic flux from the permanent magnet to release the armature.

In the clapper type, the coil is energized for printing to generate a magnetic flux thereby to attract the plate spring to the coil and printing is performed by the attracting force.

FIG. 6 is a cross sectional view showing the above-described prior-art wire-dot print head.

In such figure, provided between a guide frame 1 and a cap 2 are a base plate 3, a permanent magnet 4, an upright support 5, a spacer 6, a plate spring 7 and a yoke 8 which are stacked successively with each other and clamped by a clamp 9.

Provided on a flexible part of the plate spring 7 is an armature 10. Fixed to the tip of the armature 10 is a base part of a print wire 11, tip of which is guided by a guide 1*a* to project toward a platen.

A core 12 is provided in the center of the base plate 3. 14 is a circuit board for energizing a coil 13. 15 is a spacing sheet for positioning the board 14. 16 is a temperature-detecting thermistor. 17 is a filler having a high thermal conductivity and covering the coil 13 and the thermistor 16.

With the above structure, a magnetic circuit is formed whereby magnetic flux from the permanent magnet 4 is passed through the upright support 5, the spacer 6, the yoke 8, the armature 10, the core 12 and the base 3 and returns to the permanent magnet 4. Because of this magnetic circuit, the armature 10 is attracted to the core 12 into a biased state to store distortion energy in the plate spring 7.

In this biased state, if the coil 13 is energized to generate a magnetic flux in opposition to the magnetic circuit, the force for attracting the armature 10 is reduced.

For this reason, the distortion energy stored in the plate spring 7 is released and the plate spring 7 is restored, so that the print wire 11 fixed to the tip of the armature 10 projects from the guide 1*a* and presses an ink ribbon and a print medium against the platen.

In this way, characters and graphic patterns are printed.

By energizing the coil 13 during printing, generated heat is transmitted to the thermistor 16 through the filler 17 made of epoxy resin or the like which has a high heat conductivity, and the temperature within the wire-dot print head is supervised and the coil 13 is controlled below its maximum operating temperature.

For the permanent magnet 4, materials of the samarium-cobalt type having a high energy product (BH product) and low temperature coefficient of magnetic flux density are frequently employed.

With the above-described prior-art wire-dot print head, instead of the permanent magnet of the samarium-cobalt type containing rare, samarium and cobalt as main constituents, permanent magnets of the neodyminum type are used to increase the printing speed and to lower the price of the printer.

In such a case, the temperature coefficient of the residual magnetic flux density of the permanent magnet is four to five times greater than that of the permanent magnet of the samarium-cobalt type, and the attracting force generated by the permanent magnet 4 varies due to the heat generated by the coil 13 within the wire-dot print head. Moreover, in the worst case, the plate spring 7 cannot be attracted.

FIG. 7 shows the relationship between the attraction stroke, and the spring force and the attracting force in the prior-art wire-dot print head. Attracting force curves both at a high temperature and at a low temperature are shown.

The attracting force $F_0$ at the fully attracted point of the armature 10 decreases with a rise in temperature, and keeps decreasing to $F_1$ for the highest operating temperature of the wire-dot print head. At this temperature, the attracting force may become smaller than the spring force and failure of attraction of the plate spring may occur.

Where the printing speed is increased, the weight of the wire-dot print head is reduced, heat generated from the coil 13 during printing increased, and the heat radiation capacity is reduced. The temperature rises more quickly and reaches the maximum operating temperature in a shorter time. Because heat control is performed to suppress the temperature rise, printing is suspended or one-way printing is performed or some other action to reduce the duty ratio is taken. As a result, the printing speed (throughput) is lowered.

Another problem relates to magnetic interferences between adjacent cores. FIG. 8 is a developed view of the core for explaining the magnetic interference in the prior-art wire-dot print head.

In such figure, 12*a*, 12*b* and 12*c* are cores provided in juxtaposition. 13 is a coil. 7 is a plate spring having a print wire. When the coil 13 is not energized, the plate spring 7 is attracted by the magnetic flux, shown by solid lines, generated by the permanent magnet. When a drive current is made to flow through the coils 13 on the core 12*a* and the core 12*c*, a magnetic flux, shown by dotted lines, is generated and part of this passes through the core 12*b*.

The direction of this leakage flux is identical to the direction of the magnetic flux for attracting the plate spring 7, so the attracting force is increased. Because of the effect of the magnetic flux, when a plurality of print wires 11 are driven simultaneously, the printing force is lowered.

To compensate for this, control is made whereby the drive time for which the drive current is made to flow through the coils 13 is varied with the number of the print wires simultaneously driven, and the drive time is lengthened with the number of the driven print wires.

In such case, heat generated from the coils 13 is increased, so the print duty is further lowered.

SUMMARY OF THE INVENTION

The object of the present invention is to solve the problems of the prior-art wire-dot print head described above and to provide a wire-dot print head maintaining the maximum energy product of the permanent magnet while reducing the temperature variation, and increasing the printing duty and enabling an increase of printing speed and a reduction of size.

For this purpose, the wire-dot print head of the present invention uses, as the permanent magnet forming the magnetic circuit, a combination of a first permanent magnet of the samarium-cobalt type, and a second permanent magnet of the neodyminum-iron-boron type or the lanthanoid-iron-boron type.

According to the present invention, since a first permanent magnet of samarium-cobalt type, and a second permanent magnet of neodyminum-iron-boron type or lanthanoid-iron-boron type are used for the permanent magnet forming the magnetic circuit as described above, the maximum energy product is increased, while the rate of variation of the residual magnetic density is reduced, and the printing speed of the wire-dot print head can be increased, and the size thereof can be reduced.

Moreover, there are provided a means for detecting the temperature of the wire-dot print head, and means for shortening the coil energization time (drive time) linearly or step-wise in accordance with an increase in the detected temperature. This is for the purpose of compensating for a decrease in the attracting force due to an increase in the temperature. The drive time can be shortened to such an extent that, at the detected temperature above a threshold temperature, the printing force against the print medium is not lowered (by compensating for the decrease in the attracting force), and the heating of the coil is suppressed and the printing duty is prevented from being lowered.

DETAILED DESCRIPTION OF THE PREFERRED EMBODIMENTS

An embodiment of the invention will now be described with reference to the drawings.

Figure 1:
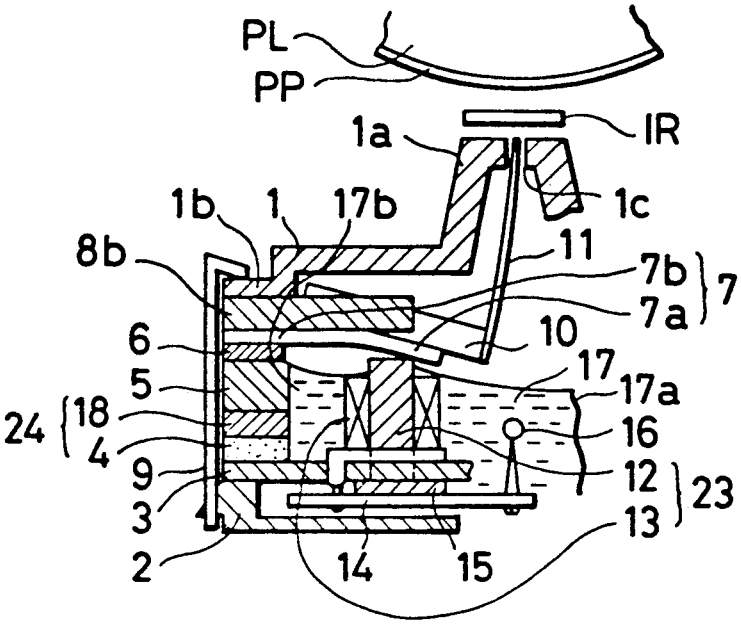
FIG. 1 is a cross sectional view of a wire-dot print head of an embodiment of the present invention.

FIG. 1 is a cross sectional view of a wire-dot print head showing an embodiment of the invention.

As illustrated, front (upper as seen in FIG. 1) ends of print wires 11 project through output guide holes 1*c* in a guide frame 1 and are directed toward a platen PL on which a printing paper PP is passed. An ink ribbon IR is interposed between the tips of the print wires 11 and the printing paper PP on the platen PL. Rear (lower as seen in FIG. 1) ends of the wires 11 are fixed to tips (inner ends) of respective armatures 10 supported by inwardly projecting parts 7*a* of a plate spring 7. The projecting parts 7*a* are supported in a cantilever fashion and are flexible. The rear (lower as seen in FIG. 1) surfaces of the armatures 10 are in confrontation with front (upper as seen in FIG. 1) ends of cores 12 on which coils 13 are wound to form electromagnets 23 for the respective wires 11. The rear (lower as seen in FIG. 1) ends of the cores 12 are fixed to a central part of a disk-shaped base plate 3 which is formed of a magnetically permeable material.

A spacing sheet 15 is provided for positioning a printed circuit board 14. A thermistor 16 is provided for detecting temperature. A filler 17 having a high thermal conductivity is provided to cover the coils 13 and the thermistor 16.

A first annular permanent magnet 4, a second annular permanent magnet 18, an annular upright support 5, an annular spacer 6, an annular part 7*b* of the plate spring 7, and an annular part 8*b* of an armature yoke 8 as well as an annular peripheral part 1*b* of the guide frame 1 form a cylindrical wall of the print head.

The first and the second permanent magnets 4 and 18 in combination form a permanent magnet assembly 24.

A magnetic circuit is formed by the first and second permanent magnets 4 and 18, the upright support 5, the spacer 6, the yoke 8, the armature 10, the core 12 and the base 3. A magnetic flux passing through the magnetic circuit attracts the armature 10 to the corresponding core 12, and the inwardly projecting part 7*a* of the plate spring 7 is brought into a biased state and distortion energy is stored in the plate spring 7.

The coils 13 of the electromagnets 23 are electrically connected by electric conductors on the printed circuit board 14 to a drive circuit, not shown, for controlled selective energization in accordance with data for printing.

The printed circuit board 14 is covered with a rear cap 2 provided at the rear (lower side as seen in FIG. 1).

The members forming the cylindrical wall of the print head drive part are clamped by a clamp member 9.

When the electromagnets 23 are not energized, the armatures 10 are attracted toward the cores 12 of the electromagnets 23 because of the magnetic flux from the permanent magnet assembly 24. The projecting parts 7*a* of the plate spring 7 are thereby resiliently deformed. When the electromagnets 23 are energized the magnetic flux due to the electromagnets 23 and the magnetic flux due to the permanent magnet assembly 24 cancel each other, and the attracting force acting on the armature 10 is reduced, being overcome by the resilient force of the plate spring 7. The distortion energy is thereby released, and the plate spring 7 returns to the free original state. As a result, the print wires 11 project out of the guide holes 1*c*, and their tips are pressed against the ink ribbon IR and the print paper PP on the platen Pl. Printing of characters and graphic patterns is thereby achieved.

Heat generated because the coil 13 is energized is conducted by the filler 17 of epoxy resin or the like having a high thermal conductivity to the thermistor 16, and the temperature within the wire-dot print head is supervised and the coil 13 is controlled to be below its maximum operating temperature.

The permanent magnet 4 is formed of a material consisting of the samarium-cobalt (Sm-Co) type which has a high energy product (BH product) and a low temperature coefficient of the magnetic flux. The second permanent magnet 18 is of the neodyminum-iron-boron type or lanthanoid-iron-boron type. The materials for the first and the second permanent magnets may be interchanged.

Figure 2:
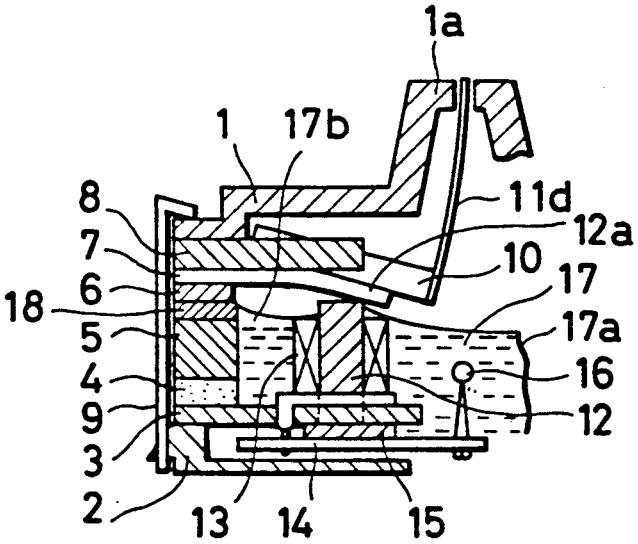
FIG. 2 is a cross sectional view of a wire-dot print head of another embodiment of the invention.

In the embodiment of FIG. 1, the first and the second permanent magnets 4 and 18 are stacked adjacent to each other. However, the first permanent magnet 4 and the second permanent magnet 18 may be separated by other members, such as the upright support 5, as shown in FIG. 2.

Figure 3:
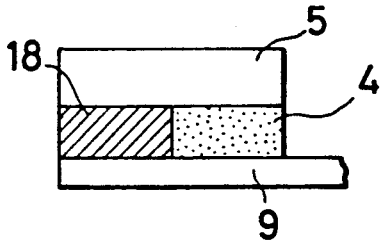
FIG. 3 is a diagram showing another example of disposition of permanent magnets.

In the above description, the first permanent magnet 4 of samarium-cobalt type and the second permanent magnet 18 of neodyminum-iron-boron type or lanthanoid-iron-boron type are provided in series. However, as shown in FIG. 3, they may be provided in parallel, an similar results will be obtained. In the example illustrated in FIG. 3, the first and the second permanent magnets 4 and 18 are both annular, with the second permanent magnet 18 having a larger diameter. More specifically, the inner periphery of the second annular permanent magnet 18 is adjacent to the outer periphery of the first permanent magnet 4. The inner periphery of the first permanent magnet 4 and the outer periphery of the second permanent magnet 18 respectively form inner and outer surfaces of the cylindrical wall.

When only the permanent magnet of neodyminum-iron-boron type of lanthanoid-iron-boron type having a higher maximum energy product than the permanent magnet of samarium-cobalt type is used, the temperature variation rate of the residual magnetic flux density is −0.11%/° C. to 0.15%/° C., larger than that a of permanent magnet of samarium-cobalt type, which is 0.03%/° C.

When the first permanent magnet 4 of samarium-cobalt type, and the second permanent magnet of neodyminum-iron-boron type are used in combination, comparied with the case where only the first permanent magnet 4 is used, the maximum energy product is increased without increasing the volume.

Moreover, compared with the case where only the neodyminum-iron-boron type or lanthanoid-iron-boron type is used, the temperature variation rate of the residual magnetic flux density can be reduced (e.g., −0.06%/° C.).

Figure 4:
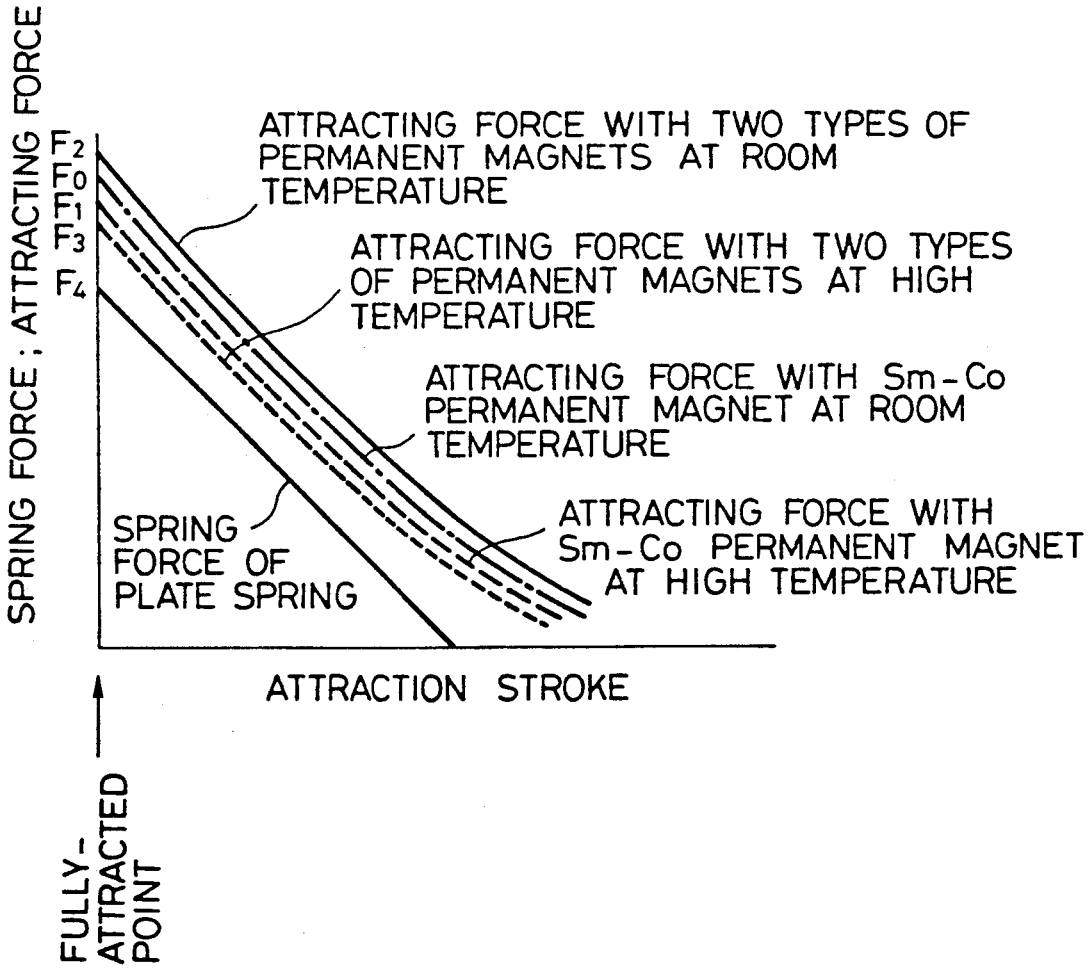
FIG. 4 is a diagram showing the relationship between the attracting stroke, and the spring force and the attracting force.

FIG. 4 shows a relationship between the attraction stoke, and the spring force and the attracting force. As illustrated, the degree of reduction of the attracting force curve for a high temperature is reduced, and it does not become lower than the curve of the spring force of the plate spring 7, and failure in attraction does not occur. As a result, it is possible to attract a plate spring having a high spring force constant, and the size of the permanent magnet can be reduced.

The attracting force F at the fully attracted point of the armature 10 is $F_2$, it is decreased with an increase in temperature, and it is $F_3$ at the maximum operating temperature of the wire-dot print head.

The holding force $F_3-F_4$ of the plate spring 7 at a high temperature is lower than the holding force $F_2-F_4$ at room temperature, and is smaller than the holding force $F_1-F_4$ at high temperature where only a samarium-cobalt type permanent magnet is used. That is, the armature is released more easily at high temperature than at room temperature. The drive time for which the coil 13 is energized above the temperature threshold level determined by the thermistor 16, is either linearly or step-wise in accordance with increase of the detected temperature. A shortening may be so made as to compensate for the decrease in the attracting force due to increase in said temperature. Moreover, the shortening is made at or above the threshold temperature.

As a result, heating of the coil 13 is suppressed and reduction of the printing duty can be prevented.

Figure 5:
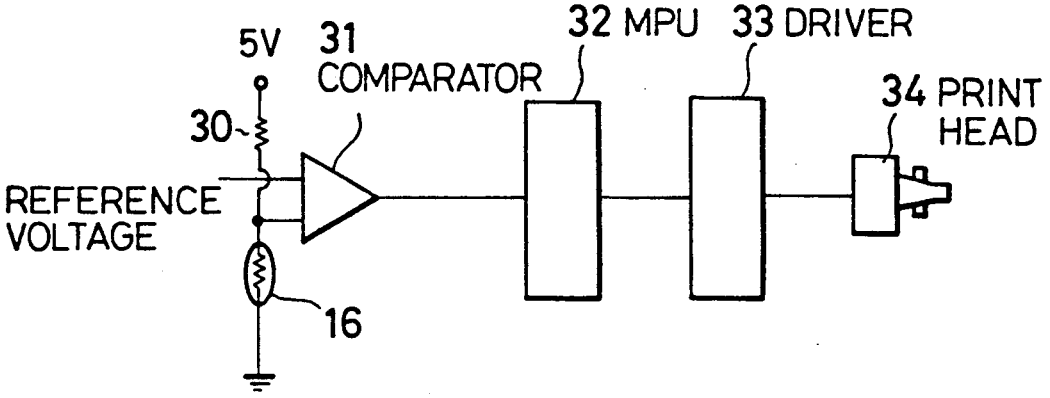
FIG. 5 is a diagram showing a circuit for controlling the time of energization of a coil.
Figure 6:
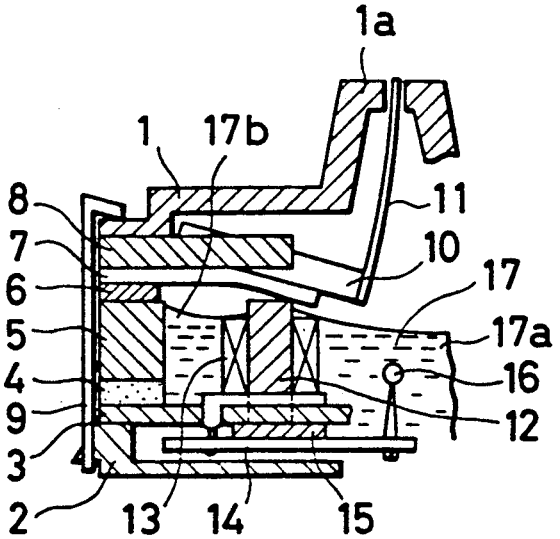
FIG. 6 PRIOR ART
FIG. 6 is a cross sectional view of a wire-dot print head of the prior art.
Figure 7:
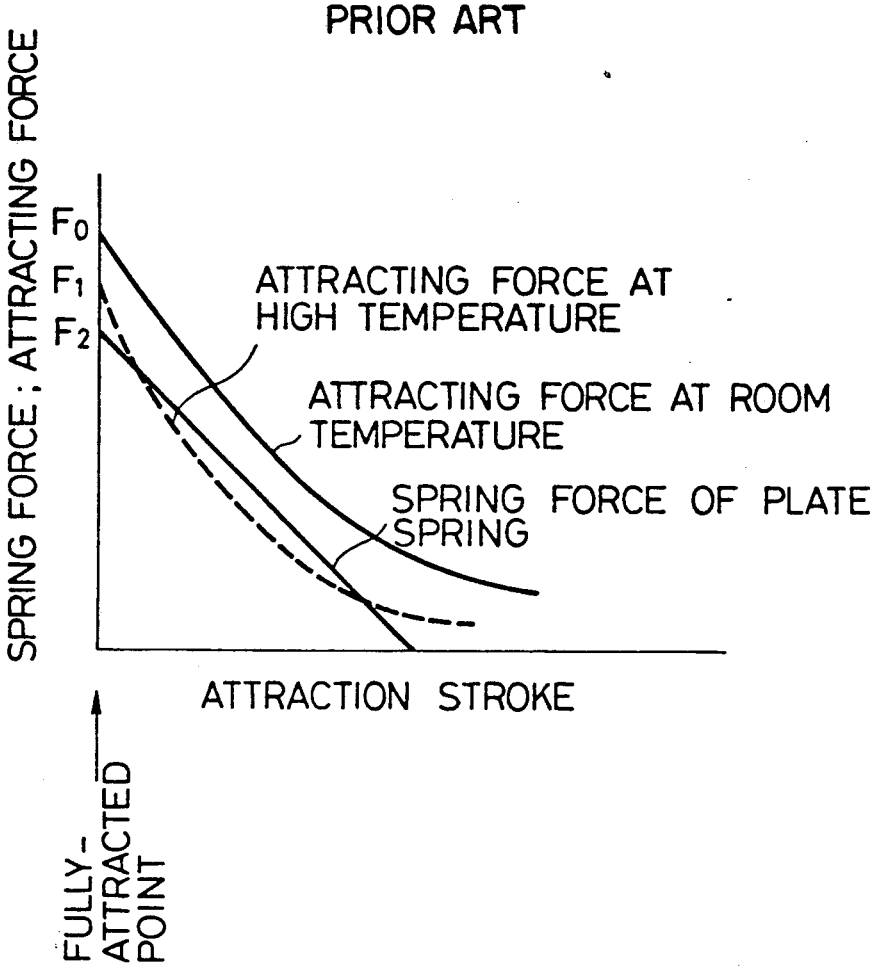
FIG. 7 PRIOR ART
FIG. 7 is a diagram showing the relationship between the attracting stroke, and the spring force and the attracting force of the prior art arrangement.
Figure 8:
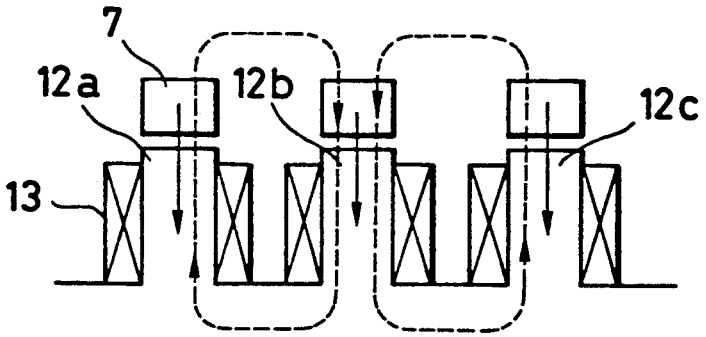
FIG. 8 PRIOR ART
FIG. 8 is a developed view of cores for illustrating magnetic interference.

FIG. 5 is a diagram of a circuit for controlling the time of coil energization.

In such figure, a resistor 30 and thermistor 16 are connected in series between a power supply (5V) and the ground to form a voltage divider providing a temperature signal indicative of the temperature of the print head. A comparator 31 receives at one input terminal the temperature signal and receives at another input terminal at a reference voltage defining the threshold level. The output of the comparator 31 is connected to a microprocessor 32, which controls a print head driver 33. When the temperature of the coil 16 exceeds the threshold level, the output of the comparator 31 is active, responsive to which the microcomputer operates, and a wire-dot print head driver 33 is controlled to vary the time of coil energization.

The present invention is not limited to the embodiments described above. Various modifications are possible without departing from the scope of the present invention.

As has been described according to the invention, a first permanent magnet of samarium-cobalt type, and a second permanent magnet of neodyminum-iron-boron type or lanthanoid-iron-boron type are used as the permanent magnet forming the magnetic circuit. The maximum energy product is increased, while the rate of variation of the residual magnetic density is reduced, and the speed of the wire-dot print head can be increased, and the size thereof can be reduced.

Moreover, since there are provided a means for detecting the temperature of the wire-dot print head, and a means for shortening the time of coil energization linearly or step-wise in accordance with increase in the temperature determined by the detecting means, the drive time can be shortened to such an extent that, when the temperature determined by the thermistor is above the threshold temperature, the printing force against the print medium is not lowered. Heating of the coil is therefore suppressed and the printing duty is prevented from being lowered.

Furthermore, when the drive time of the coil is lengthened for preventing magnetic interference, the peaks of the drive currents are reduced, so the printing duty (throughput) is not lowered.

What is claimed is:

1. A wire-dot print head comprising:

an armature having a tip to which a print wire is secured;

a core provided in confrontation with said armature;

a plate spring which is supported in a centilever fashion and to which said armature is fixed;

a permanent magnet assembly generating a magnetic flux to cause said armature to be attracted toward said core overcoming the resilient force of said plate spring; and a coil wound on said core to generate a magnetic flux upon energization to cancel the magnetic flux from said permanent magnet assembly thereby to release said armature;

wherein said permanent magnet assembly comprises a first permanent magnet of samarium-cobalt type, and a second permanent magnet of neodyminum-iron-boron type or lanthanoid-iron-boron type.

2. A wire-dot print head as set forth in claim 1, wherein said first permanent magnet and said second permanent magnet are provided in series with each other along a magnetic circuit for passing said magnetic flux.

3. A wire-dot print head as set forth in claim 1, wherein said first permanent magnet and said second permanent magnet are provided in parallel with each other along a magnetic circuit for passing said magnetic flux.

4. A wire-dot print head as set forth in claim 1, wherein a plurality of print wires, a plurality of corresponding cores, and a plurality of corresponding coils are provided;

said plate spring has a plurality of inwardly projecting parts for respective said armatures;

rear ends of said print wires are fixed to said respective armatures supported by respective said inwardly projecting parts of said plate spring;

rear surfaces of said armatures are in confrontation with front ends of respective said cores on which respective said coils are wound to form respective electromagnets for respective said print wires;

rear ends of said cores are fixed to a disk-shaped base plate which is formed of a magnetically permeable material;

said first permanent magnet, said second permanent magnet, an upright support and a spacer are all annular;

said plate spring has an annular part;

a guide frame has an annular peripheral part; and said first permanent magnet, said second permanent magnet, said upright support, said spacer, said annular part of the plate spring, an annular part of an armature yoke, said annular peripheral part of said guide frame form a cylindrical wall of said print head.

5. A wire-dot print head as set forth in claim 4, wherein said cylindrical wall forms part of a magnetic circuit through which a magnetic flux for attracting each said armature toward the corresponding said core is passed.

6. A wire-dot print head as set forth in claim 5, wherein said first annular permanent magnet and said second annular permanent magnet are stacked with each other in series with each other in said magnetic circuit.

7. A wire-dot print head as set forth in claim 5, wherein one of said first and second annular permanent magnets is inside of the other, so that they are in parallel with each other in said magnetic circuit.

8. A wire-dot print head as set forth in claim 4, wherein said coils of the electromagnets are electrically connected by electric conductors on a printed circuit board to a drive circuit for controlled selective energization in accordance with data for printing.

9. A printer comprising:

a wire-dot print head as set forth in claim 1;

means for detecting the temperature of said wire-dot print head; and means for shortening the time of coil energization linearly or step-wise in accordance with an increase in said temperature determined by said detecting means.

10. A printer according to claim 9, wherein said shortening means shortens the time of coil energization to compensate for a decrease in the attracting force due to an increase in said temperature.

* * * * *